United States Patent [19]

Freyn

[11] 4,203,402

[45] May 20, 1980

[54] MEANS FOR SECURING AN INJECTION NOZZLE

[75] Inventor: Fritz Freyn, Graz, Austria

[73] Assignee: Hans List, Graz, Austria

[21] Appl. No.: 826,998

[22] Filed: Aug. 23, 1977

[30] Foreign Application Priority Data

Aug. 26, 1976 [AT] Austria ..... 6346/76

[51] Int. Cl.[2] ..... F02M 39/00

[52] U.S. Cl. ..... 123/139 AW; 123/32 R

[58] Field of Search ..... 123/32 R, 139 AW, 195 A, 123/198 E; 248/507, 508; 85/1 T, 61; 403/2

[56] References Cited

U.S. PATENT DOCUMENTS

| | | | |
|---|---|---|---|
| 3,038,456 | 6/1962 | Dreisin | 123/32 R |
| 3,334,617 | 8/1967 | Palkowsky | 123/32 R |
| 3,453,993 | 7/1969 | Saletzki et al. | 123/32 R |
| 3,695,235 | 8/1970 | Anderson | 123/32 R |

*Primary Examiner*—Ira S. Lazarus
*Assistant Examiner*—Magdalen Moy
*Attorney, Agent, or Firm*—Watson, Cole, Grindle & Watson

[57] ABSTRACT

Means for attaching an elongated injection nozzle to a cylinder head of an injection-internal combustion engine, which head includes means presenting a nozzle receiving bore in a surface thereof, the attachment means comprising, means in the cylinder head presenting a threaded guide hole disposed adjacent the nozzle receiving bore and extending generally in the same direction as the bore, abutment means on the injection nozzle including a surface extending transversely of the longitudinal axis of the nozzle and facing away from the cylinder head, elongated clamp means having a member at one end disposed in contact with the nozzle surface facing away from the cylinder head and collar means at the other end presenting an opening disposed in alignment with the guide hole, the collar means including an element that is elongated in the direction of the guide hole and extends into the latter, the element and guide hole cooperating to limit movement of the clamp means in directions other than parallel to the guide hole, and screw means extending through the collar means and into threaded engagement with the threads of the guide hole for forcing the member of the clamp means and thereby the injection nozzle toward the cylinder head.

4 Claims, 4 Drawing Figures

MEANS FOR SECURING AN INJECTION NOZZLE

BACKGROUND OF THE INVENTION

This invention is related to a means for attaching an injection nozzle to a cylinder head for an injection-internal combustion engine and is more particularly concerned with a nozzle which is insertable into a nozzle receiving bore which nozzle is forced axially against a section of the receiving bore by a clamp means on the cylinder head. The clamp means is comprised of a threaded guide hole, and a collar having a member, preferably a forked-shaped pressure piece, detachably connecting the nozzle and the clamp means.

The prior art, particularly French Pat. No. 1,538,194, discloses a screw on a spiral spring at a distance from the channel in the cylinder head for receiving the injection nozzle. The free end of the spring engages an annular extension on the nozzle body in the shape of a fork and biases the extension sealingly against the edge of the channel to secure the injection nozzle in its operating position. The spring is incapable of absorbing the axial pressure generated in diesel engines. Additionally, a considerable bending strain on the attaching screw will occur at the transition point between the screw head and the shaft of the screw due to the strain on the projecting spring.

Another prior art method for attachment of a nozzle on injection-internal combustion engines uses a so-called fork bride which is supported on one end by placement of its fork-like pressure piece against milled slots on both sides of the nozzle holder and on the other end against a plane milling slot of the cylinder head and which are secured by a single clamping screw passing through an eye in the middle part of the fork bride. This construction requires an additional processing expenditure for the plane supporting surface on the cylinder head. The machining of the plane frequently causes difficulty due to the very restricted spatial conditions on the top side of the cylinder head. Additionally, the fork bride may become loose during the release as well as during tightening of the injection line on the nozzle due to the high torque generated. Further, due to the relatively great play of the clamping screw in the eye of the fork bride, precisely maintaining the insertion position of the nozzle holder in the direction sought, is compromised. Consequently, errors in operating direction will result for the injection holes of the nozzle which is particularly disadvantageous in the case of an insertion position of the nozzle which is oblique in relation to the combustion cylinder axis.

SUMMARY OF THE INVENTION

Accordingly, it is the object of the present invention to provide a cylinder head which will ensure a solid, simple and space-saving method of attachment of the injection nozzle and provide for both vertical and oblique insertion positioning of the nozzle in the cylinder head.

Another object of the invention is to provide an attaching arrangement comprising clamp means insertable into a threaded guide hole of the cylinder head and secured by a screw means penetrating the clamp means axially and cooperating with the threaded section of the guide hole. The clamp means has a member engaged with milled recesses in the shaft of the injection nozzle or engaged at the outside end of a cap screw on the injection nozzle.

A further object of the invention is to provide a method of attachment of the injection nozzle in the restricted space available, enabling more efficient manufacture of the cylinder head, per se, and providing an improved means to absorb the axial securing forces. This method of attachment is equally suited to all customary insertion positions of an injection nozzle. The elongated element of the collar means extending into the threaded guide hole absorbs the forces caused by the eccentric engagement of the clamp means acting on the nozzle, therefore only the attaching screw means has to absorb the tensile stresses. This method of attachment also prevents any loosening of the nozzle during the disassembly or attachment of the injection line.

An additional advantage of more precise maintenance of the holding position of the nozzle in the peripheral direction will also result. The centering of the nozzle in the cylinder head permits less twisting of the nozzle in the clamp means as opposed to the prior art fork bride.

The invention also encompasses the positioning of the threaded guide hole of the clamp means at an angle in relation to the nozzle, since the rigid clamp means is capable of absorbing the resulting bending moment. In the case of the prior art fork bride method, this is not possible because of the high bending strain on the clamping screw.

Whenever the fork-like projections of the clamp means engage with the recesses of the nozzle shaft, nozzles existing in series with corresponding milled-in recesses may be used without constructional changes. Furthermore, the axes of the nozzle and of the threaded guide hole may be moved very close together requiring decreased space for the attaching arrangement.

In the disclosed embodiment wherein the clamp means engages the outside front surface of a screw cap on the nozzle, any processing of supporting milled surfaces on the nozzle becomes superfluous. This arrangement is particularly advantageous when the nozzle is disposed at an oblique angle relative to the axis of the combustion cylinder.

Further objects, advantages, and features of the invention will be apparent in the arrangement and construction of the constituent elements in detail as set forth in the following specification taken together with the accompanying drawings.

DETAILED DESCRIPTION OF THE PREFERRED EMBODIMENTS

Figure 1:
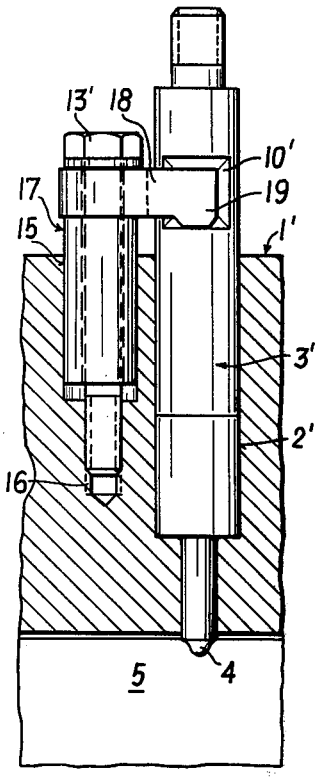
FIG. 1 is a side view in cross-section of the injection nozzle attachment means.

The cylinder head 1' has a cylindrical guide bore 15 parallel to the nozzle receiving bore 2' for the nozzle 3'. The guide bore 15 has a threaded guide hole 16 coaxially aligned and located inwardly of the guide bore 15.

A hollow cylindrical guide casing 17 insertable into the guide bore 15 has fixedly attached to its outside end a fork-shaped pressure piece 18, with two cams 19 to engage milled recesses 10' on opposing sides of the nozzle 3'. The clamping of the nozzle 3' on the cylinder head 1' is accomplished by a clamping screw 13' which penetrates the casing 17 and is screwed into the threaded guide hole 16 of the guide bore 15. In the case of tightening the clamping screw 13', the guide bore 15 absorbs the moments caused by the eccentric engagement of the clamping force acting on the nozzle 3'.

Figure 3:
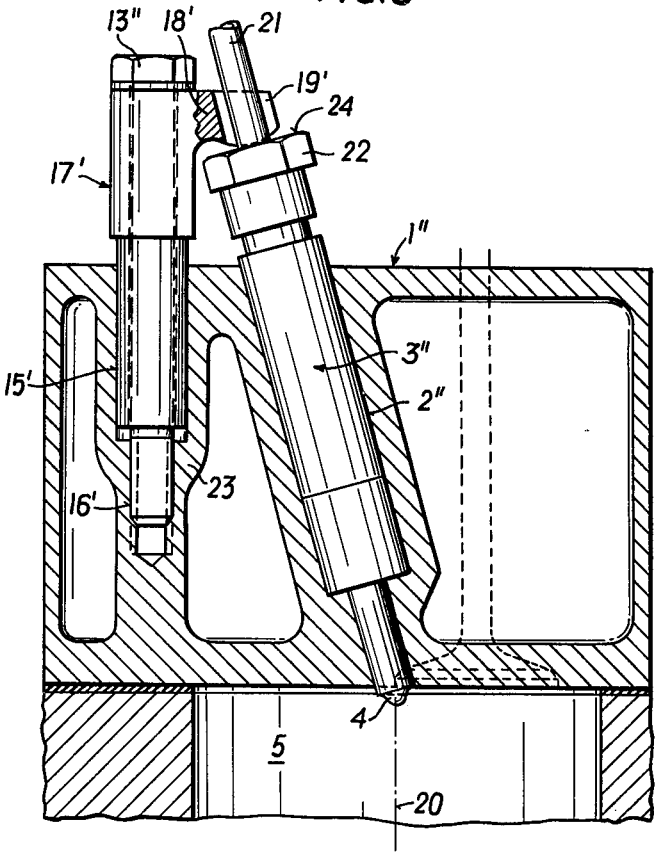
FIG. 3 is a side view in cross-section of another embodiment of the injection nozzle attachment means.
Figure 2:
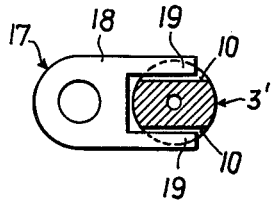
FIG. 2 is a top view of the injection nozzle attachment means of FIG. 1.
Figure 4:
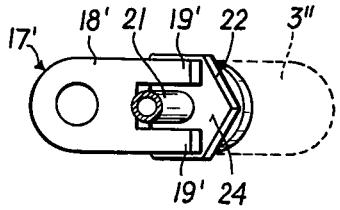
FIG. 4 is a top view of the injection nozzle attachment means of FIG. 3.

A second embodiment is disclosed in FIGS. 3 and 4. The nozzle holder 3" is disposed in a nozzle receiving bore 2" inclined in relation to the cylinder axis 20 of the combustion cylinder 5. The injection line 21 is fixed by means of a screw cap 22 fixedly attached to the nozzle 3".

As in the first described embodiment, the attachment of the nozzle holder 3" on the cylinder head 1" is accomplished by means of a cylindrical casing 17' cooperating with a fixedly attached pressure piece 18' to exert an inward axial pressure on the screw cap 22. The guide bore 15' with the threaded guide hole 16' is provided here in a separate batch 23 cast into the cylinder heal 1". The two cams 19' provided at the upper edge of the casing 17' of the pressure piece 18' engage the outside front surface 24 of the screw cap 22. The tightening of the nozzle 3" is accomplished as in the first described embodiment, by means of a clamping screw 13" penetrating the casing 17' and threaded into threaded guide hole 16'. The small space requirement for the attachment means of each of the disclosed embodiments is clearly apparent.

While there has been shown and described what is considered to be preferred embodiments of the present invention, it will be obvious to those skilled in the art that various changes and modifications may be made therein without departing from the invention as defined in the appended claims.

I claim:

1. Means for attaching an elongated injection nozzle to a cylinder head of an injection-internal combustion engine, which head includes means presenting a nozzle receiving bore in a surface thereof, said attachment means comprising:

means in said head presenting a guide hole disposed adjacent said bore and extending generally in the same direction as said bore, and a threaded bore at the end of said guide hole;

abutment means on said nozzle including a surface extending transversely of the longitudinal axis of the nozzle and facing away from said head;

elongated clamp means having a member at one end disposed in contact with said surface and collar means at the other end presenting an opening disposed in alignment with said guide hole; said collar means integrally including a sleeve-like element elongated in the direction of said guide hole and extending into the latter, said element and said guide hole cooperating to limit movement of said clamp means in directions other than parallel to said guide hole; and screw means extending through said sleeve-like element and into threaded engagement with the threads of said threaded bore for forcing the member of the clamp means, and thereby said nozzle, toward said head.

2. The invention of claim 1, wherein the elongated clamp means comprises a forked pressure piece having spaced opposing cams, said abutment means comprising a pair of recesses disposed on respective opposite sides of said nozzle, each cam being disposed in contacting relationship with a respective one of said recesses.

3. The invention of claim 2, wherein said nozzle comprises a screw cap at its outer end connecting an injection pipe to the nozzle, said screw cap having an upper surface presenting said abutment means which is engaged by said forked pressure piece.

4. The invention of claim 1, wherein said bore and said hole are disposed in substantial parallelism.

* * * * *